US007757323B2

(12) United States Patent
Watkins et al.

(10) Patent No.: US 7,757,323 B2
(45) Date of Patent: Jul. 20, 2010

(54) BELT DRIVE WASHER

(75) Inventors: Derek L. Watkins, Elizabethtown, KY (US); Scott Dunn, Smithfiled, KY (US); Greg Miller, Louisville, KY (US); Mark Weaver, Crestwood, KY (US); Edward McInerney, Louisville, KY (US)

(73) Assignee: General Electric Company, Schenectady, NY (US)

( * ) Notice: Subject to any disclaimer, the term of this patent is extended or adjusted under 35 U.S.C. 154(b) by 704 days.

(21) Appl. No.: 11/447,768

(22) Filed: Jun. 6, 2006

(65) Prior Publication Data

US 2007/0094812 A1 May 3, 2007

Related U.S. Application Data

(63) Continuation-in-part of application No. 11/262,566, filed on Oct. 31, 2005.

(51) Int. Cl.
*D06F 33/00* (2006.01)

(52) U.S. Cl. ..... 8/159; 68/12.16; 68/12.23; 68/140

(58) Field of Classification Search ..... 68/12.01, 68/12.16, 12.23, 12.24, 131, 133, 139, 140; 8/159

See application file for complete search history.

(56) References Cited

U.S. PATENT DOCUMENTS 2,974,542 A * 3/1961 Barbulesco et al. ..... 74/665 K
3,128,615 A * 4/1964 Mahaffay ..... 68/12.12
3,327,727 A 6/1967 Anastasia
3,520,158 A * 7/1970 Takeyama ..... 68/23.6
3,525,241 A 8/1970 Morton
3,575,057 A 4/1971 Kurowski
3,744,325 A 7/1973 Brucken
3,772,925 A 11/1973 Sisson
3,805,563 A 4/1974 Wendorf
3,978,693 A 9/1976 Worst
4,018,096 A 4/1977 Foster
4,059,975 A 11/1977 Jacobs
4,061,000 A 12/1977 Jacobs
4,184,347 A * 1/1980 Tobita et al. ..... 68/12.23
4,250,724 A 2/1981 Altnau
4,440,004 A 4/1984 Bochan
4,802,347 A 2/1989 Nystuen
4,824,422 A 4/1989 Jocic (Continued)

OTHER PUBLICATIONS

Advisory Action mailed from the U.S. Patent Office on Jan. 4, 2010; U.S. Appl. No. 11/262,566; 5 pages.

(Continued)

*Primary Examiner*—Joseph L Perrin
(74) *Attorney, Agent, or Firm*—George L. Rideout, Esq.; Armstrong Teasdale LLP

(57) ABSTRACT

A drive mechanism for a washing machine having a basket rotatably mounted within a tub includes a motor having a first pulley. A washing apparatus is mounted within the basket. A rotatable shaft has first and second ends, the first end being directly coupled to the washing apparatus. A second pulley is mounted on the second end of the shaft. A drive belt connects the first pulley to the second pulley. An inverter is operatively coupled to the motor. A controller is operatively coupled to the inverter and the motor. The controller is configured to control the motor based on a predetermined agitation profile.

14 Claims, 4 Drawing Sheets

U.S. PATENT DOCUMENTS

| | | | | |
|---|---|---|---|---|
| 4,922,151 | A | 5/1990 | Lewis | |
| 5,267,456 | A | 12/1993 | Nukaga et al. | |
| 5,720,685 | A | 2/1998 | Malone | |
| 5,737,944 | A | 4/1998 | Nishimura et al. | |
| 5,784,901 | A * | 7/1998 | Yanase et al. | 68/27 |
| 5,809,808 | A * | 9/1998 | Andriano et al. | 68/23.7 |
| 5,842,358 | A | 12/1998 | Koo et al. | |
| 5,862,685 | A * | 1/1999 | Lim | 68/23.7 |
| 5,887,458 | A | 3/1999 | Bae | |
| 6,189,171 | B1 | 2/2001 | Savkar et al. | |
| 6,448,727 | B1 | 9/2002 | Rotterhusen | |
| 2004/0010860 | A1 | 1/2004 | Johanski et al. | |
| 2004/0098812 | A1 | 5/2004 | Herzog et al. | |

OTHER PUBLICATIONS

Office Action mailed from the U.S. Patent Office on Oct. 9, 2009, U.S. Appl. No. 11/262,566; 16 pages.

Office Action mailed from the U.S. Patent Office on Feb. 19, 2009; U.S. Appl. No. 11/262,566; 12 pages.

Final Office Action mailed from the U.S. Patent Office on Sep. 2, 2008; U.S. Appl. No. 11/262,566; 9 pages.

Office Action mailed from the U.S. Patent Office on Mar. 13, 2008; U.S. Appl. No. 11/262,566; 21 pages.

* cited by examiner

BELT DRIVE WASHER

CROSS REFERENCE TO RELATED APPLICATIONS

This application is a continuation-in-part of U.S. application Ser. No. 11/262,566, filed Oct. 31, 2005, and entitled "Belt Drive Washer", which is hereby incorporated by reference in its entirety.

BACKGROUND OF THE INVENTION

This invention relates generally to washing machines, and more particularly, to belt driven washers having no transmission.

Washing machines typically include a cabinet that houses an outer tub for containing wash and rinse water, a perforated clothes basket within the tub, and an agitator within the basket. A drive motor and transmission are mounted underneath the outer tub to rotate the agitator relative to the basket and a pump assembly pumps water from the tub to a drain to execute a wash cycle.

Generally, the transmission provides gear reduction from the motor for agitate and spin functions. However, known washer transmissions include rather inflexible washer platforms. For example, the transmissions typically have a non-variable agitator motion, including stroke, ramp rate, arc, and arc length. Generally, with a transmission, only the agitation rate or speed can be changed without changing the transmission. Furthermore, the transmission adds to the part count and the overall complexity of the washer drive mechanism.

BRIEF DESCRIPTION OF THE INVENTION

In one aspect, a drive mechanism for a washing machine having a basket rotatably mounted within a tub is provided. The drive mechanism includes a motor including a first pulley. A washing apparatus is mounted within the basket. A rotatable shaft has first and second ends. The first end is directly coupled to the washing apparatus. A second pulley is mounted on the second end of the shaft. A drive belt connects the first pulley to the second pulley. An inverter is operatively coupled to the motor. A controller is operatively coupled to the inverter and the motor. The controller is configured to control the motor based on a predetermined agitation profile.

In another aspect, an agitation cycle for a washing machine includes repeating an agitation profile for a predetermined period of time. Repeating an agitation profile may include repeating two or more agitation profiles in a sequential manner. Repeating an agitation profile may also include repeating two or more agitation profiles in a random manner. The agitation cycle further includes modifying the agitation profile in response to the torque requirements of a wash load.

In a further aspect, an agitation profile for a washing apparatus stroke in a washing machine is provided. The agitation profile includes the steps of providing a motor for driving the washing apparatus, starting the washing apparatus at an angular speed of zero, accelerating the washing apparatus at a predetermined acceleration rate to a predetermined angular speed, holding the washing apparatus at the predetermined angular speed for a predetermined dwell time, and decelerating the washing apparatus to an angular speed of zero after the predetermined dwell time is reached.

DETAILED DESCRIPTION OF THE INVENTION

Figure 1:
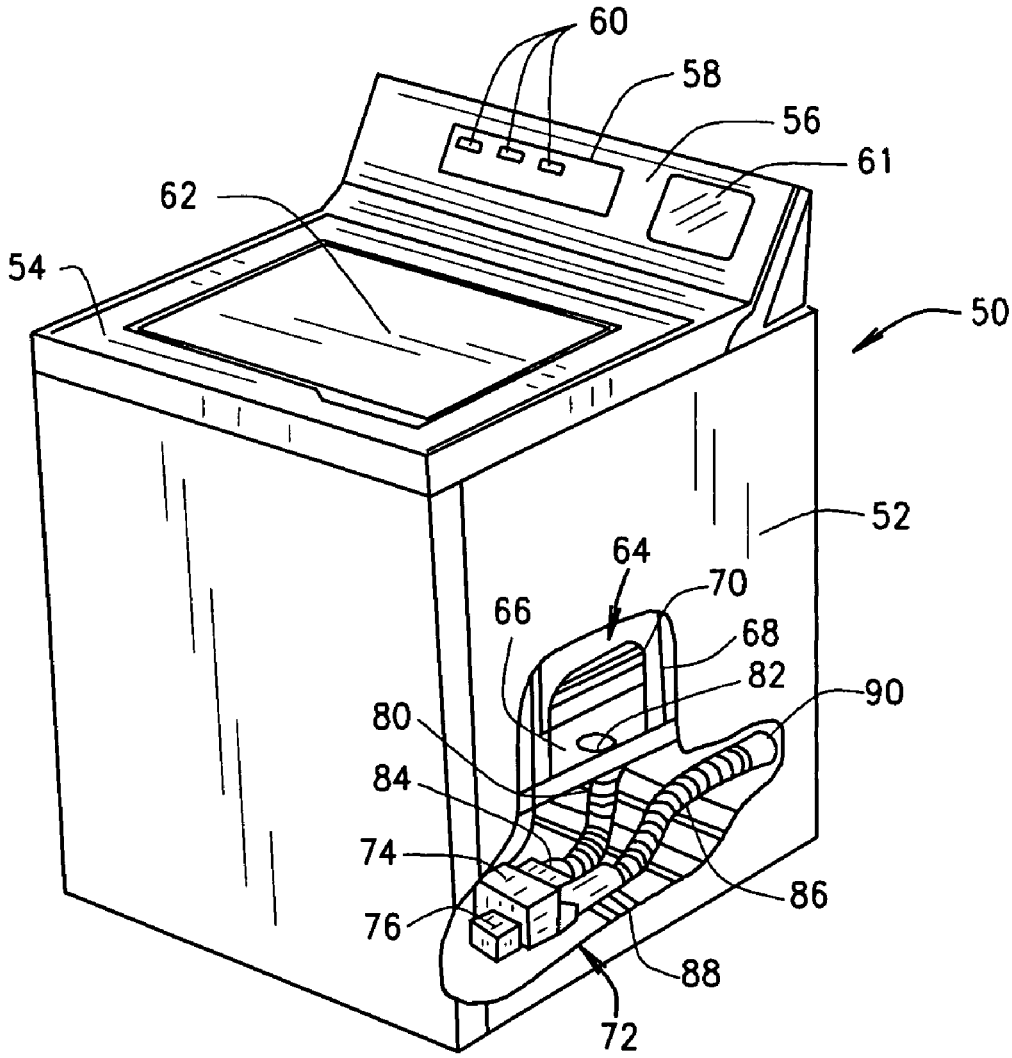
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine.

Tub 64 includes a bottom wall 66, a sidewall 68, and a basket 70 that is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 85 extends from a pump outlet 88 to an appliance washing machine water outlet 90 and ultimately to a building plumbing system discharge line (not shown) in flow communication with outlet 90.

Figure 2:
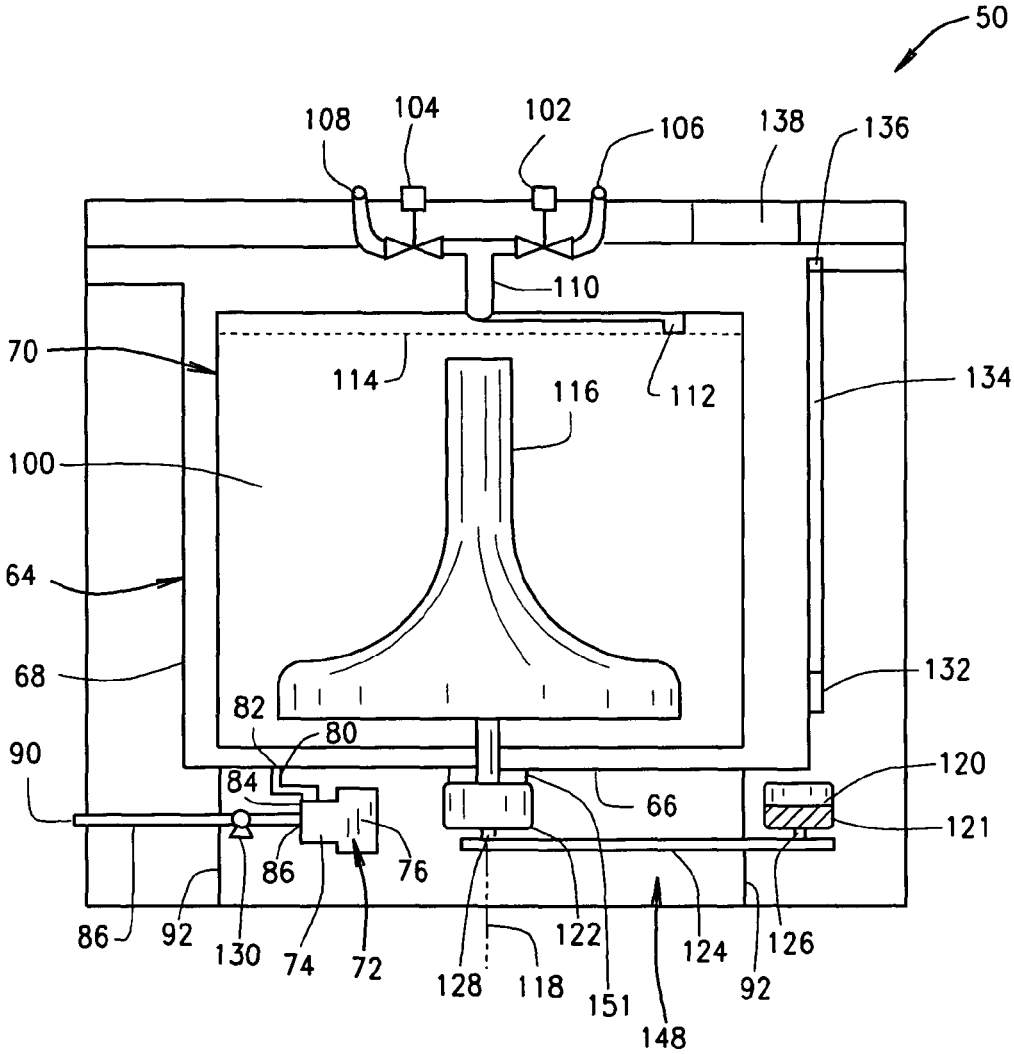
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. In one embodiment, basket 70 includes a plurality of perforations therein to facilitate fluid communication between an interior of basket 70 and wash tub 64. In an alternative embodiment, only a bottom 71 of basket 70 is perforated.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of spray fill conduit 114 are a plurality of openings arranged in a predetermined pattern to direct incoming streams of water in a downward tangential manner towards articles in basket 70. The openings in spray fill conduit 114 are located at a predetermined distance or distances apart from one another to accommodate a constant or variable spacing as desired to produce an overlapping coverage of liquid streams into basket 70. Articles in basket 70 may therefore be uniformly wetted even when basket 70 is maintained in a stationary position.

A washing apparatus 116 is mounted within basket 70. Washing apparatus 116 imparts mechanical energy directly to a clothes load in basket 70 to clean the clothes load. In an exemplary embodiment, washing apparatus 116 is a known agitation element mounted within basket 70. In other embodiments, washing apparatus may take other forms, such as an impellor, a pulsator, or a neutator, all of which are well known in the art. In the discussion that follows, washing apparatus 116 will be referred to generally as agitation element 116.

Figure 3:
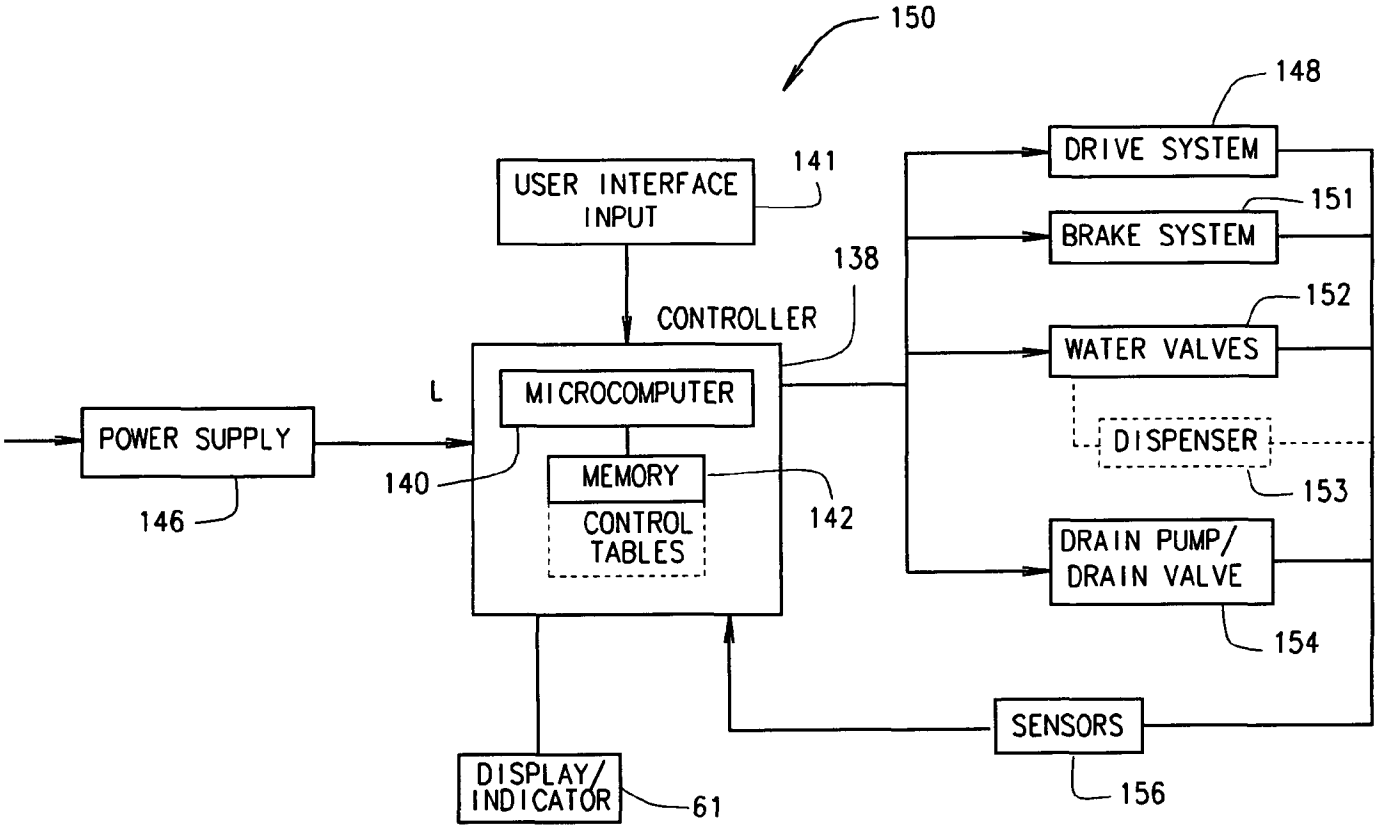
FIG. 3 is a schematic block diagram of a control system for the washing machine shown in FIGS. 1 and 2.

As illustrated in FIG. 2, agitation element 116 is oriented to rotate about a vertical axis 118. Basket 70 and agitator 116 are driven by a variable speed motor 121. An inverter 120 is operatively coupled to motor 121 and is configured to control motor 121 in response to signals from a controller 138 (FIG. 3). A drive belt 124 is coupled to respective pulleys of a motor output shaft 126 and an agitator input shaft 128 as will be described. In one embodiment, a clutch system 122 facilitates driving engagement of basket 70 and agitation element 116 for rotatable movement within wash tub 64. In another embodiment, clutch system 122 facilitates relative rotation of basket 70 and agitation element 116 for selected portions of wash cycles. Motor 121, clutch system 122, when present, and agitation element 116 collectively are referred to herein as a machine drive system 148. Washing machine 50 does not include a transmission.

Pump assembly 72 is selectively activated to remove liquid from basket 70 and tub 64 through drain outlet 90 and a drain valve 130 during appropriate points of washing cycles. In an exemplary embodiment, machine 50 also includes a reservoir 132, a tube 134, and a pressure sensor 136. As fluid levels rise in wash tub 64, air is trapped in reservoir 132 creating a pressure in tube 134, that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts. Drive system 148 may be configured to be one of current limited, voltage limited, and torque limited.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

The washing operation is initiated through operator manipulation of control input selectors 60 (shown in FIG. 1). In one embodiment, washing machine 50 is a direct drive washer that is configured to provide a basket wash wherein laundry items are washed by oscillating basket 70 and agitator 116 together. That is, basket 70 and agitator 116 rotate as a unit with no relative motion therebetween. The mechanical wash action is achieved by the relative motion between the laundry items and the basket and agitator combination, 70 and 116 respectively, when tub 64 is filled with a wash liquid. Basket 70 and agitation element 116 are moved back and forth in an oscillatory back and forth motion. In the illustrated embodiment, basket 70 and agitation element 116 are rotated clockwise about the vertical axis 118 of the machine, and then rotated counterclockwise about the vertical axis 118. The clockwise/counterclockwise reciprocating motion is sometimes referred to as a stroke, and the agitation phase of the wash cycle constitutes a number of strokes in sequence. Acceleration and deceleration of basket 70 and agitation element 116 during the strokes imparts mechanical energy to articles in basket 70 for cleansing action. In washing machine 50, reversible motor 121 provides the stroke action during agitation of the laundry items. In some embodiments of the basket wash system, basket 70 includes a perforated bottom 71 and non-perforated side walls.

In another embodiment, washing machine 50 agitator 116 and basket 70 are rotatable with respect to one another to provide a conventional wash cycle. In such embodiments, washing machine 50 includes clutch 122 that is configured to lock and unlock basket 70 and agitator 166 in response to signals from controller 138. In an exemplary embodiment, clutch 122 is a two-position clutch that is controlled to lock and unlock agitator 116 to basket 70 and to lock and unlock basket 70 to tub 64. During agitation, basket 70 is locked and agitator 116 oscillates within basket 70 to agitate the laundry items. Agitator 116 is directly driven by reversing motor 121 without a transmission. In some embodiments, this washing machine design includes a conventional basket having perforated side walls. When washing machine 50 is configured to provide a conventional wash, washing machine 50 may also be provided with a mode shifter (not shown) to couple the agitator and basket together during spin operations and lock basket 70 in place during agitation.

After the agitation phase of the wash cycle is completed, tub 64 is drained with pump assembly 72. Laundry items are then rinsed and portions of the cycle repeated, including the agitation phase, depending on the particulars of the wash cycle selected by a user.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator enters instructions or selects desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 121, inverter drive 120, clutch system 122, and agitation element 116 shown in FIG. 2), a brake assembly 151 associated with basket 70 (shown in FIG. 2) which may be provided, machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153

(shown in phantom in FIG. 3) so that water may be mixed with detergent or other composition of benefit to washing of garments in wash basket 70.

Figure 4:
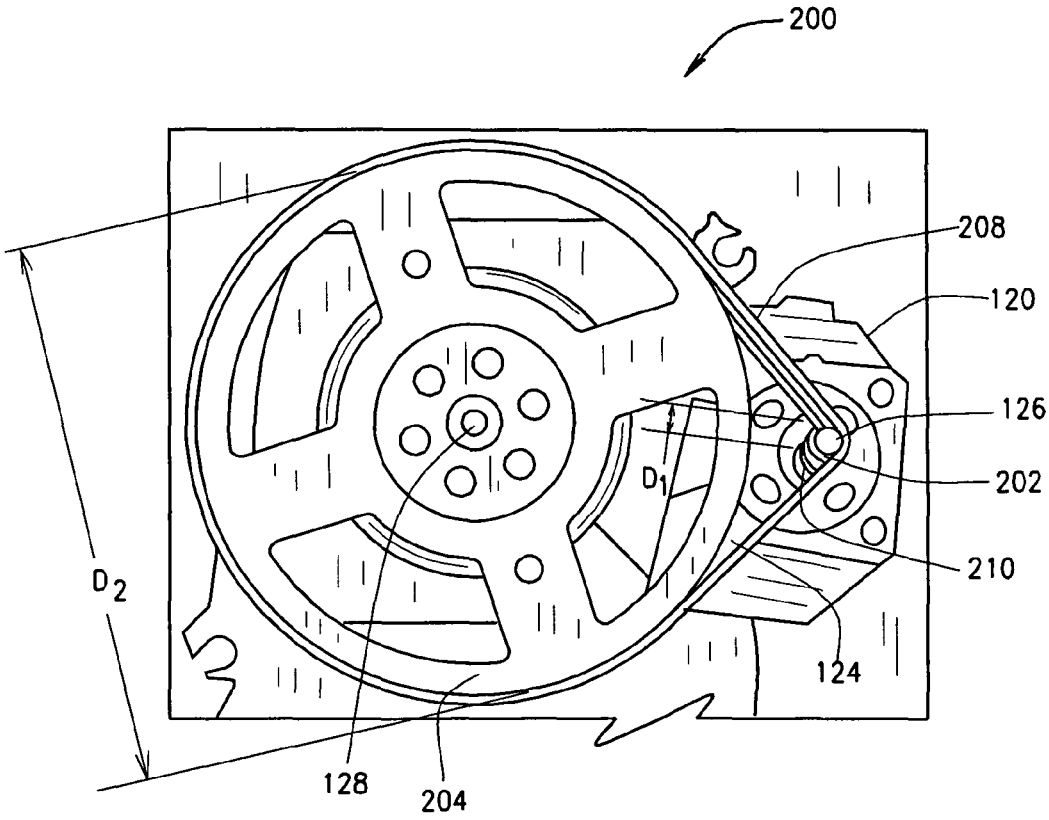
FIG. 4 is a fragmentary view showing an exemplary belt drive system.

FIG. 4 is a fragmentary view showing an exemplary belt drive system 200 for a washing machine such as washing machine 50. Belt drive system 200 includes reversible motor 121 having an output shaft 126 which includes a first pulley 202. A second pulley 204 is mounted on agitator input shaft 128. Drive belt 124 interconnects first pulley 202 and second pulley 204. Motor 121 is a direct drive motor that drives agitator 116 without the use of a transmission. Pulleys 202 and 204 effectively provide a gear reduction that eliminates the need for a transmission. In an exemplary embodiment, drive belt 124 is a known V-belt that has ribs or grooves 208 on the under side. First pulley 202 on motor 121 is formed with mating grooves 210. In one embodiment, motor 121 may be fabricated to include an output shaft with grooves 210 formed directly thereon.

First pulley 202 has a diameter $D_1$ and second pulley 204 has a second diameter $D_2$. Speed reduction from motor 121 to agitator input shaft 128 is determined by the ratio of diameter $D_2$ to diameter $D_1$. When washing machine 50 is designed to provide the basket wash, the ratio of diameter $D_2$ to $D_1$ is greater than the ratio of diameter $D_2$ to $D_1$ when washing machine 50 is designed to provide the conventional wash because the basket wash requires a higher torque than the conventional wash. In an exemplary embodiment, the ratio of diameter $D_2$ to $D_1$ is at least ten to one for the basket wash mode. In alternative embodiments, for the conventional wash, the ratio of diameter $D_2$ to $D_1$ is at least six to one.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines. In an exemplary embodiment, sensors 156 may include one or more speed sensors, and acceleration/deceleration sensors to detect the speed of agitator 116.

Controller 138 is configured to control motor 121 and inverter 120 based on a predetermined agitation profile. For washing machine 50, controller 138 may be programmed with one or more agitation profiles that include predetermined stroke, speed, and ramp rate parameters. In exemplary embodiments, the agitation profiles are time based rather than displacement based. More specifically, in the time based profile, each stroke has a specified time interval rather than the more conventional displacement distance. When strokes are displacement based, increased motor torque is required as load size increases. In washing machine 50, the stroke is shortened with the time based agitation profile so as to avoid over heating of motor 121.

An agitation profile defines an agitator stroke. For instance, an exemplary time based agitation profile defines an agitator stroke that includes starting with the agitator at an angular speed of zero, accelerating agitator 116 at a predetermined acceleration rate to a predetermined target angular speed, holding agitator 116 at the predetermined angular speed for a predetermined dwell time, decelerating agitator 116 to an angular speed of zero after the dwell time is reached and at a predetermined deceleration rate. The direction of motor 121 is reversed when the angular speed of agitator 116 reaches zero and the agitator stroke is repeated in the reverse direction. A total time is determined to repeat the agitation stroke process.

Deceleration of agitator 116 may be either powered or unpowered, or a combination of the two. That is, in an unpowered deceleration, agitator 116 is allowed to coast to a stop. In a powered deceleration, agitator 116 is decelerated while under the influence of motor 121. Further, in some embodiments, agitator stroke may be symmetrical while in other embodiments, agitator stroke may be asymmetrical. In addition, though not preferred, dwell time, in some embodiments, may be substantially zero.

A wash cycle, or agitation cycle, includes one or more agitation profiles performed in a repeating fashion for the duration of the wash cycle. In a time based agitation profile, agitator displacement is at least partially time based. During the agitation cycle, motor 121 at least attempts to maintain agitator 116 at the target angular speed for the predetermined dwell time. After the predetermined dwell time is reached, agitator 116 is decelerated and the direction of agitator 116 is reversed. Similarly, if agitator 116 cannot achieve or maintain the target angular speed, such as when a wash load is too large, agitator 116 is decelerated and the direction reversed after the predetermined dwell time is reached. In this manner, the displacement of agitator 116 is adaptive to the load on motor 121 which facilitates reducing heat in motor 121. In an exemplary embodiment, an agitation profile includes accelerating the agitator to a target speed of 80 revolutions per minute (RPM) at a constant acceleration rate of 240 RPM/second, holding the agitator at 80 RPM for one half second and decelerating the agitator back to zero RPM at a constant rate of 240 RPM/second. When the agitator is stopped, the direction of rotation is reversed and the motor repeats the cycle of accelerating the agitator to a target speed of 80 RPM.

Since motor 121 directly drives agitator 116, motor 121 changes direction during the agitation cycle. In one embodiment, motor heat is reduced by allowing motor 121 to coast to a stop before a spin direction change occurs. That is, motor 121 is turned off and the motor is allowed to slow down to reduce the amount of time that the motor is used as a brake. In alternative embodiments, changes in agitator direction are accompanied by a controlled ramp down with the motor running rather than turning the motor completely off.

The above described apparatus provides a drive system for washing machines that eliminates a transmission. The system provides improved reliability with a reduction in cost. Additionally, agitation parameters may be changed without the need to replace the transmission. The system provides an agitation profile wherein the displacement of the agitator is adaptive to the load on the motor such that motor heat is reduced.

While the invention has been described in terms of various specific embodiments, those skilled in the art will recognize that the invention can be practiced with modification within the spirit and scope of the claims.

What is claimed is:

1. An agitation profile for a stroke of a washing apparatus mounted within a basket of a washing machine, the agitation profile comprising:

providing a motor having a first pulley for driving the washing apparatus;

providing a rotatable shaft having first and second ends, the first end directly coupled to the washing apparatus;

providing a second pulley mounted on the second end;

coupling the first pulley to the second pulley by a drive belt;

operatively coupling an inverter to the motor;

operatively coupling a controller to the inverter and to the motor, the controller configured to control the motor based on a predetermined agitation profile that is adaptive to a load on the motor, the predetermined agitation profile having a predetermined target angular speed and a predetermined dwell time for the washing apparatus, and the motor configured to decelerate the agitator if the agitator is unable to reach the predetermined target angular speed after the predetermined dwell time is reached;

starting the washing apparatus at an angular speed of zero;

accelerating the washing apparatus at a predetermined acceleration profile to the predetermined target angular speed;

holding the washing apparatus at the predetermined target angular speed for the predetermined dwell time; and decelerating the washing apparatus to an angular speed of zero after the predetermined dwell time is reached.

2. An agitation profile in accordance with claim 1 wherein decelerating the washing apparatus comprises decelerating the washing apparatus at a predetermined deceleration profile.

3. An agitation profile in accordance with claim 1 further comprising reversing a direction of the washing apparatus when the angular speed of washing apparatus reaches zero.

4. An agitation profile in accordance with claim 1 wherein decelerating the washing apparatus comprises allowing the washing apparatus to coast to a stop with the motor turned off before changing a direction of rotation of the washing apparatus.

5. An agitation profile in accordance with claim 1 wherein decelerating the washing apparatus at a predetermined deceleration profile comprises a controlled stop of the washing apparatus with the motor running.

6. A drive mechanism for a washing machine having a basket rotatably mounted within a tub, said drive mechanism comprising:

a motor including a first pulley;

a washing apparatus mounted within the basket;

a rotatable shaft having first and second ends, said first end directly coupled to said washing apparatus;

a second pulley mounted on said second end of said shaft;

a drive belt connecting said first pulley to said second pulley;

an inverter operatively coupled to said motor; and a controller operatively coupled to said inverter and said motor, said controller configured to control said motor based on a predetermined agitation profile that is adaptive to a load on said motor, said predetermined agitation profile comprising a predetermined target rotation speed and a predetermined dwell time for said washing apparatus, and said motor configured to decelerate said agitator if said agitator is unable to reach said predetermined target rotation speed after said predetermined dwell time is reached.

7. The drive mechanism in accordance with claim 6 wherein said agitation profile further comprises:

a predetermined acceleration profile for said washing apparatus to reach the target rotation speed;

a predetermined deceleration profile for said washing apparatus to stop before reversing a direction of said motor.

8. The drive mechanism in accordance with claim 7 wherein said predetermined deceleration profile includes at least one of a powered deceleration and an unpowered deceleration.

9. The drive mechanism in accordance with claim 6 wherein said predetermined dwell time for said washing apparatus is zero.

10. The drive mechanism in accordance with claim 6 wherein the basket and the washing apparatus move together during agitation with no relative motion therebetween.

11. The drive mechanism in accordance with claim 6 wherein the washing apparatus is rotatable with respect to the basket and said drive mechanism further comprises a clutch operatively coupled to the basket and said shaft, said controller controlling said clutch to lock and unlock said washing apparatus to the basket.

12. The drive mechanism in accordance with claim 6 wherein the drive mechanism is at least one of torque limited, current limited, and voltage limited.

13. The drive mechanism in accordance with claim 6 further comprising at least one sensor responsive to at least one of a rotational speed, acceleration, and deceleration of said washing apparatus.

14. The drive mechanism in accordance with claim 6 wherein said washing apparatus comprises one of an agitator, a neutator, a pulsator, and an impellor.

* * * * *